United States Patent [19]

Irish

[11] 4,365,973

[45] Dec. 28, 1982

[54] MIDDLE DISTILLATE FUEL ADDITIVE

[75] Inventor: Glenn E. Irish, Fullerton, Calif.

[73] Assignee: Union Oil Company of California, Los Angeles, Calif.

[21] Appl. No.: 217,915

[22] Filed: Dec. 18, 1980

[51] Int. Cl.[3] ..... C10L 1/22

[52] U.S. Cl. ..... 44/56; 44/57; 44/62; 44/DIG. 1

[58] Field of Search ..... 44/62, 57, 56, DIG. 1; 585/13, 14

[56] References Cited

U.S. PATENT DOCUMENTS

| | | | |
|---|---|---|---|
| 2,211,732 | 8/1940 | Sachanen et al. | 585/13 |
| 2,726,942 | 12/1955 | Arkis | 44/56 |
| 3,910,776 | 10/1975 | Feldman | 44/62 |
| 3,915,668 | 10/1975 | Basalay | 44/62 |
| 3,961,916 | 6/1976 | Ilnyckyj et al. | 44/62 |
| 3,966,428 | 6/1976 | Rossi | 44/62 |
| 3,981,850 | 9/1976 | Wisotsky et al. | 44/62 |
| 3,982,909 | 9/1976 | Hollyday, Jr. | 44/66 |
| 3,999,960 | 9/1976 | Langer, Jr. et al. | 44/62 |
| 4,000,986 | 1/1977 | Specht et al. | 44/62 |
| 4,058,371 | 11/1977 | Ilnyckyj | 44/62 |
| 4,108,613 | 8/1978 | Frost, Jr. | 44/62 |
| 4,113,442 | 9/1978 | Hoff et al. | 44/66 |
| 4,175,926 | 11/1980 | Wisotsky | 44/62 |
| 4,210,424 | 7/1980 | Feldman et al. | 44/62 |
| 4,211,534 | 7/1980 | Feldman | 44/62 |
| 4,227,889 | 10/1980 | Perilstein | 44/57 |

*Primary Examiner*—Charles F. Warren
*Assistant Examiner*—Y. Harris-Smith
*Attorney, Agent, or Firm*—Cleveland R. Williams; Gregory F. Wirzbicki; Dean Sandford

[57] ABSTRACT

Middle distillate fuel additives, especially diesel fuel additives, are disclosed which improve one or more cold flow properties of said fuel such as cetane, pour point, wax formation and anti-icing characteristics. The additives comprise a cold flow improver, preferably a vinyl acetate-ethylene copolymer, a cetane improver comprising paraffinic nitrate or a mixture of nitrates, an anti-icer comprising an aliphatic alcohol or a cyclic aliphatic alcohol having from 1 to 6 carbon atoms or mixtures thereof and an oil soluble aromatic solvent.

24 Claims, No Drawings

MIDDLE DISTILLATE FUEL ADDITIVE

BACKGROUND OF THE INVENTION

1. Field of the Invention

This invention relates to cold flow additives for middle distillate fuels which improve the flowability and filterability thereof at low temperatures.

In geographical areas which experience severe winter weather, users of middle distillate fuel oils, especially diesel fuel, have encountered problems caused by water droplets entrained in and wax separation from said fuel oils at low temperature. This wax and water, the latter in the form of ice crystals, clog fuel lines, strainers and filters preventing and/or restricting the flow of said fuel to apparatus or engines designed to utilize the fuel. In extremely cold weather, solidification of middle distillate fuel in fuel tanks and lines occurs, because when a wax-containing oil, for example, a middle distillate fuel oil, is cooled it will eventually congeal due to the precipitation of wax.

Additives have been used in the petroleum industry for many years to improve the low-temperature properties and characteristics of petroleum-derived middle distillate fuels. These additives, commonly termed cold flow improvers, wax crystal modifiers and/or pour point depressants act by changing the morphology of wax crystals, reducing the pour point of said fuels and by reducing or preventing the formation of ice crystals from water entrained in the middle distillate fuel (i.e., anti-icing agent).

The major influence of cold flow additives for middle distillate fuels is in reducing the size and shape of wax and/or water crystals, i.e., ice, and their tendency to form a fuel trapping matrix. These additives effectively lower the pour point of the fuel and enhance its low temperature flow properties.

2. Description of the Prior Art

The use of additives to impart desirable physical and chemical properties to middle distillate fuels during cold weather is known and appreciated by the prior art.

For example, U.S. Pat. No. 4,211,534, to Feldman discloses a three or more component additive system for distillate fuel oils which consists of (1) an ethylene polymer or copolymer, (2) a second polymer having alkyl side chains of 6 to 30 carbon atoms, derived from carboxylic acid esters and/or olefins and (3) nitrogen compounds, such as amides, amine salts and ammonium salts of carboxylic acids or anhydrides. the additives are described as useful in improving the cold flow properties of distillate hydrocarbon fuel oils.

U.S. Pat. No. 4,113,442, to Hoff et al. relates to middle distillate compositions which contain a filterability improver which consists of a mono- or polyester of a specified $C_{10}$–$C_{40}$ hydrocarbyl alcohol and a hydroxycarboxylic acid. These compositions may contain small amounts of unreacted alcohols or of fully or partially unconverted alcohols. In addition, the composition may contain a pour-point depressant.

Suitable pour-point depressants include copolymers of ethylene and vinyl esters, alkylacrylates, alkylmethylacrylates or alkylfumarates, chlorinated polyethylene, alkylated aromatics alkylated polystyrene, fully or partially hydrogenated polymers or copolymers of olefins, for example butadiene or mixtures of butadiene and styrene, and, polyalkylacrylates or methacrylates and mixtures thereof.

Another cold flow additive for middle distillate fuels is disclosed in U.S. Pat. No. 4,058,371 to Ilnyckyj, which discloses an oil-soluble, alkphatic copolymer suitable for use as a nucleator for wax crystallization, in combination with an oil-soluble derivative of an aromatic copolymer. Ethylene-vinyl acetate copolymers having an average molecular weight of from 500 to 50,000 are described as desirable nucleators for wax crystallization.

U.S. Pat. No. 3,910,776, to Feldman, relates to cold flow additives for distillate fuel oil which consists of combinations of (A) alkyl aromatics consisting of the condensaton product of chlorinated wax and naphthalene, with (B) ethylene containing copolymers and/or (C) N-aliphatic hydrocarbyl succinamic acids and their amine salts.

U.S. Pat. No. 3,380,815, to Herbst, discloses a cetane improver for diesel fuel oil which consists of adding a small amount of a gem dinitrolalkanoate to a diesel fuel. The gem dinitrolalkanoate is prepared by the base-catalyzed condensation of a dinitroalkane and an $\alpha$-$\beta$-unsaturated ester.

From the foregoing, it can be seen there is an ongoing search for cold flow additives suitable for use in combination with middle distillate fuels.

It is a principle object of this invention to reduce or prevent the formation of wax and ice crystals in middle distillate hydrocarbon stocks at low temperatures.

It is yet another object of this invention to increase the cetane number of middle distillate hydrocarbon stocks.

SUMMARY OF THE INVENTION

The present invention resides in a middle distillate fuel oil having improved cold flow, cetane and anti-icing properties which comprises a mixture of a major amount of a middle distillate hydrocarbon stock in combination with a minor amount of a cold flow additive, wherin said cold flow additive comprises:

(A) A cold flow improver selected from an ethylene-vinyl acetate copolymer having a molecular weight within the range of from 800 to 120,000, a vinyl acetate homopolymer having a molecular weight within the range of from 800 to 120,000, and a vinyl acetate-acrylic ester copolymer or a vinyl acetate-methaacrylic ester copolymer having a molecular weight within the range of from 800 to 120,000, and mixtures thereof, wherein the alkyl group of the ester contains from 6 to 16 carbon atoms.

(B) A cetane improver selected from a paraffinic nitrate or a mixture of paraffinic nitrates, wherein the paraffinic group contains from 4 to 16 carbon atoms, (C) An anti-icing agent selected from an aliphatic alcohol or a cyclic aliphatic alcohol having from 1 to 6 carbon atoms, and mixtures thereof, and (D) An aromatic solvent having a gravity within the the range of from 25° to 32° API, and which boils within the range of from 275° F. to 550° F., and mixtures thereof.

The cold flow additives for middle distillate fuels herein described preferably comprise a vinyl acetate-ethylene copolymer in combination with a mixture of octyl nitrates, aliphatic alcohols having from 1 to 6 carbon atoms or mixtures thereof, preferably isopropanol and methanol and an oil soluble aromatic solvent.

DETAILED DESCRIPTION OF THE INVENTION

The present invention resides in a middle distillate fuel oil having improved cold flow properties and/or a cold flow additive which comprises, in combination a cold flow improver, a cetane improver, an anti-icing agent, and an aromatic solvent. In particular, the invention herein relates to a cold flow additive per se or to a middle distillate fuel oil comprising a mixture of a middle distillate hydrocarbon stock and said additive. Normally, the middle distillate fuel oil contains a minor amount preferably from about 0.1% to 5.0%, especially from about 0.2% to 2.0% by volume of said cold flow additive.

Suitable cold flow additives comprise:

(A) from about 3% to 24 percent by volume, especially from about 3 to 20 percent by volume of a cold flow improver selected from an ethylene-vinyl acetate copolymer having a molecular weight within the range of from about 800 to 120,000, preferably from about 800 to 100,000, a vinyl acetate homopolymer having a molecular weight within the range of from about 800 to 120,000, especially from about 800 to 100,000, a vinyl acetate-acrylic ester, or a vinyl acetate-methacrylic ester copolymer having a molecular weight within the range of from about 800 to 120,000, preferably from about 800 to 100,000, and mixtures thereof, wherein said esters contain from about 6 to 16 carbon atoms, especially from about 6 to 12 carbon atoms, (B) from about 4 to 41 percent by volume, preferably from about 4 to 35 percent by volume of a cetane improver selected from a paraffinic nitrate or a mixture of paraffinic nitrates wherein the paraffinic group contains from about 4 to 16 carbon atoms, preferably from about 5 to 12 carbon atoms, (C) from about 2 to -percent by volume especially from about 2 to 12 percent by volume of an anti-icing agent selected from an aliphatic alcohol or a cyclic alphatic alcohol having from 1 to 6 carbon atoms, especially from about 1 to 4 carbon atoms, and (D) from 12 to 91 percent by volume, preferably from 12 to 80 percent by volume of an aromatic solvent having a gravity within the range of from 25° to 32° API, preferably, from 26° to 28° API, and which boils within the range of from 275° F. to 550° F., especially from 360° F. to 420° F.

Generally, the cold flow additive is produced by adding the respective components to the aromatic solvent. The additive may be admixed with a middle distillate fuel or packaged separately in premeasured amounts for use with said fuel at the convenience of the user. The respective components are added to the aromatic solvent to ensure a uniform mixture of cold flow additive during and after the mixing period.

Normally, the aromatic solvent and cold flow improver are admixed in a volume ratio of from about 2:1 to 20:1, especially from about 2:1 to 15:1, part of aromatic solvent per part of cold flow improver. Similarly, the aromatic solvent and cetane improver are admixed in a volume ratio of from about 1:1 to about 10:1, preferably from about 1:1 to about 8:1, aromatic solvent per part of cetane improver. The aromatic solvent and anti-icing agent are generally admixed in a volume ratio of from about 4:1 to 40:1, normally from about 4:1 to 30:1, part of aromatic solvent per part of anti-icing agent. The method of admixing the cold flow additive herein may be conveniently performed using conventional methods and techniques.

When middle distillate fuel oils are cooled, for example in areas which experience extreme temperatures, wax crystals form and said oils become more viscous, eventually reaching their cloud point and pour point. An increase in viscosity reduces the middle distillate fuel oil flow rate through pumping and distribution systems, including fuel storage tanks, fuel lines and fuel filters. Flow can and often does entirely cease when the middle distillate fuel oils' pour point is reached.

The cold flow improvers herein modify the structure of the wax crystals formed when middle distillate fuel oil is cooled below its normal pour point, thereby permitting the fuel oil to flow at temperatures below the pour point of the additive-free fuel oil. The cold flow improvers used herein are preferably selected from the group of ethylene-vinyl acetate copolymers, vinyl acetate homopolymers, vinyl acetate acrylic ester copolymers or vinyl acetate-methacrylic ester copolymers, and mixtures thereof. The ester moiety of the cold flow improvers herein normally have from about 5 to 16 carbon atoms, preferably from about 5 to about 12 carbon atoms.

The ethylene-vinyl acetate copolymers described herein preferably have a molecular weight within the range of from about 800 to 120,000, especially from about 800 to 100,000. The copolymers are conveniently formed using conventional techniques. For example, ethylene is reacted with a vinyl alcohol ester of a monocarboxylic acid, i.e., vinyl acetate at elevated temperature and pressure in the presence of a conventional free radical promoter, such as peroxide or an azo-type compound, including acyl peroxides of $C_2$ to $C_{18}$ branched or unbranched carboxylic acids, alkyl peroxides, etc. including di-benzoyl peroxide, di-tertiary butyl peroxide, di-tertiary butyl perbenzoate, tertiary butyl hydroperoxide, azo-diisobutyronitrile, di-lauroyl peroxide and the like.

Alternatively, the ethylene-vinyl acetate copolymer may be formed by thermal polymerization in a pressure vessel at a temperature of from 158° F. to 480° F., at a pressure of from 800 p.s.i.g. to 10,000 p.s.i.g.

The vinyl acetate homopolymers herein, have a molecular weight range of from about 800 to 120,000, preferably from about 800 to 100,000. Vinyl acetate may be polymerized using the procedure set forth for the ethylene-vinyl acetate copolymers above, the ethylene moiety of the composition, however, is not included in the reaction.

Another class of copolymer that may be polymerized and used as cold flow improvers include the vinyl acetate-acrylic esters and vinyl acetate-methacrylic esters having a molecular weight range of from about 800 to 120,000, preferably from about 800 to 100,000.

The unsaturated monomers which are copolymerizable with each other include unsaturated mono-and diesters of the general formula:

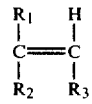

wherein $R_1$ is hydrogen or methyl, $R_2$ is a —$COOR_4$, straight or branched chain alkyl group, and $R_3$ is hydrogen or —$COOR_4$ wherein $R_4$ is hydrogen or a $C_1$ to $C_{16}$, preferably a $C_1$ to $C_4$, straight or branched chain alkyl group. The monomer, when $R_1$ and $R_3$ are hydrogen and $R_3$ is —$COOR_4$ includes vinyl alcohol esters of $C_2$ to $C_{17}$ monocarboxylic acids, preferably $C_1$ to $C_{12}$ monocarboxylic acid. Examples of such esters include vinyl acetate, vinyl isobutyrate, vinyl laurate, vinyl myristate, vinyl palmitate, and the like.

When $R_2$ is —$COOR_4$, such esters include methyl acrylate, isobutyl acrylate, and lauryl acrylate. When $R_1$ is methyl and $R_3$ is hydrogen, the esters include palmityl alcohol ester of alpha-methylacrylic and (methacrylic acid). The above-described monomers may be conveniently copolymerized with each other using conventional techniques and apparatus to provide the desired copolymer.

The cetane improver herein is preferably selected from a paraffinic nitrate or mixtures of paraffinic nitrates, wherein the paraffinic group contains from about 4 to 16 carbon atoms, especially from about 5 to 12 carbon atoms. Representative examples include butyl nitrate. amyl nitrate, hexyl niytrate, heptyl nitrate, octyl nitrate, nonyl nitrate, decyl nitrate, undecyl nitrate, dodecyl nitrate, tridecyl nitrate, tetradecyl nitrate, pentadecyl nitrate and hexadecyl nitrate, their isomers and mixtures thereof. Especially desirable cetane improvers include a mixture of primary amyl nitrates designated as Ethyl DII, a mixture of primary hexyl nitrates designated as Ethyl DII-2, and a mixture of primary octyl nitrates designated as Ethyl DII-3, all of which are sold commercially by the Ethyl Corporation.

The anti-icing agent may be any of the aliphatic alcohols or cyclic aliphatic alcohols which have from about 1 to 4 carbon atoms. Generally, the anti-icing agent is selected from methanol, ethanol, propanol, isopropanol, butanol, pentanol, cyclopentanol, hexanol and cyclohexanol, including their isomers and mixtures thereof. An especially desirable anti-icing agent includes methanol and isopropanol in a volume ratio range of from about 1:2 to 1:10, preferably from about 1:2 to 1:8 parts of methanol per part of isopropanol.

The aromatic solvent herein is preferably derived from a petroleum source, for example crude oils which are conventionally available throughout the petroleum industry. Normally, the aromatic solvent or mixtures of aromatics which are useful herein include those petroleum aromatics or mixtures thereof having a gravity range of from about 25° to 32° API, preferably from about 26° to 28° API and a distillation range of from about 275° F. to 550° F., especially from about 360° F. to about 420° F. The solvent employed should, of course, be selected with regard to the possible beneficial or adverse effects it may have on the final fuel oil composition. Thus, the solvent used should preferably burn without leaving an objectionable residue, and should be non-corrosive with regard to metals. A particularly desirable aromatic solvent (i.e., mixture of aromatics) is marketed and sold commercially under the trade name of AMSCO-SOLV G, by the Union Oil Company of California.

Hydrogen feedstocks suitable for use as a middle distillate fuel source herein include either natural or synthetic liquid hydrocarbons. Natural liquid hydrocarbons suitable for use as feedstock include crude petroleum, shale oil, tar sand bitumen, petroleum distillates and petroleum residues.

Synthetic liquid hydrocarbons may be derived from solid carbonaceous materials such as anthracitic materials, bituminous and sub-bituminous coal, lignitic materials, peat, coke, coal oil and other types of coal products referred to in ASTM Designation 388-66 (reapproved 1972). Conventional techniques and apparatus may be used to upgrade the solid carbonaceous material to a synthetic liquid hydrocarbon feedstock. A typical process and apparatus for producing liquid hydrocarbon from solid carbonaceous materials are disclosed in U.S. Pat. Nos. 4,032,429 and 4,081,361, the disclosures of which are incorporated herein by reference.

Solid carbonaceous materials are conveniently converted to synthetic liquid hydrocarbon feedstock by contacting the solid carbonaceous material with hydrogen, a solvent and a standard hydrogenation catalyst at a reaction temperature between 500° F. to about 900° F., a reaction pressure of from about 500 p.s.i.g. to about 10,000 p.s.i.g. and a space velocity of from about ½ to about 2 pounds of solid carbonaceous material and solvent per pound of catalyst per hour. Hydrogen is introduced into the reaction at a hydrogen flow rate of from about 8,000 to about 25,000 SCF of hydrogen per ton of dry solid carbonaceous feedstock per hour.

In general the distillate hydrocarbon stocks useful for preparing the fuel oil compositions of this invention will boil in the range of 250° to 900° F., and will have cloud points usually from about −20° F. to about 45° F. The hydrocarbon stock can comprise straight run, or cracked gas oil, or a blend in any proportion of straight run and thermally and/or catalytically cracked distillates, etc. The most common petroleum middle distillate hydrocarbon stocks are kerosene, diesel fuels, jet fuels and heating oils. The low temperature flow problem is most usually encountered with diesel fuels and with heating oils.

A typical heating oil specification calls for a 10 percent ASTM D-1160 distillation point no higher than about 440° F., a 50 percent point no higher than about 520° F., and a 90 percent point of at least 540° F. and no higher than about 640° F. to 650° F., although some specifications set the 90 percent point as high as 675° F.

A typical specification for a diesel fuel includes a minimum flash point of 100° F., and a 90 percent distillation point (ASTM:D-1160) between 540° F. and 640° F. , (See ASTM Designations 496 and 975).

An example of a high cloud point diesel fuel is a 40° F. cloud point fuel having an initial boiling point of about 350° F., a 90 percent distillation point of about 733° F. and a final boiling point of about 847° F. (ASTM:D-1160).

The following Examples serve to further illustrate and instruct one skilled in the art the best mode of how to practice this invention and are not intended to be construed as limiting thereof.

EXAMPLE I

Control

An additive-free No. 2 diesel fuel, having the properties set forth in Table 1 below is tested for cold flow properties in accordance with the procedure disclosed hereinafter.

TABLE 1

| Gravity, °API<br>Distillation, °F. | No. 2 diesel fuel |
|---|---|
| | 33.2 |
| IBP | 408 |
| 10% Recovered | 444 |
| 50% Recovered | 506 |
| 90% Recovered | 580 |

TABLE 1-continued

| Gravity, °API<br>Distillation, °F. | No. 2 diesel fuel |
|---|---|
| 95% Recovered | 606 |
| E.P. | 632 |
| % Botts | 1.5 |
| % Recovered | 98.0 |
| Cloud Point, °F. | −5 |
| Pour Point, °F. | −10 |
| Cetane Number | 43 |

A Saran Oldsmoble filter and fuel line are positioned in a two-gallon can full of diesel fuel described in Table 1. The fuel is then cooled to the desired temperature in a refrigeration unit. A vacuum of 6 inches of mercury is then used to draw the fuel through the filter and fuel line into a large graduated receiver. Fuel flow is measured by timing successive 100 ml aliquots of diesel fuel drawn into the receiver.

A pressure differential of 6 inches of mercury is chosen because it is in the range in which diesel vehicle failures are experienced. The filterability of the fuel through an Oldsmobile sock-type tank filter (Saran Oldsmobile filter) is tested by successively lowering the temperature of the diesel fuel and testing for fuel flow. At −7.7° F. all of the fuel filtered rapidly through the system, except for a small inaccessible heel remaining in the container.

When the temperature is lowered to −10.7° F., the filter begins to plug after a relatively small volume of fuel passes through it. The plugging is rapid and virtually complete after 2.7 to 2.9 liters of fuel passes through the filter. At −13.7° F., catastrophic plugging of the filter is observed.

EXAMPLE II

The No. 2 diesel fuel and procedure of Example I are utilized to test a cold flow additive with the following exception:

A concentration of 0.47 percent by volume (12 ounces/20 gal fuel) of a cold flow additives, having the composition disclosed in Table 2 below is added to the No. 2 diesel fuel.

TABLE 2

| Component | Cold Flow Additive<br>Function | Volume % |
|---|---|---|
| Vinyl acetate[a] | Cold Flow Improver | 11.56 |
| Methanol | Anti-icer | 2.37 |
| Isopropanol | Anti-icer | 3.99 |
| Mixed Octyl Nitrates[b] | Cetane Improver | 23.26 |
| Solvent G[c] | To Improve Handling Characteristics | 58.82 |

[a]Vinyl acetate homopolymer having a molecular weight of 8,000.
[b]Mixed primary octyl nitrates, sold commercially by the Ethyl Corporation under the tradename Ethyl DII-3.
[c]AMSCO Solvent G, a mixture of petroleum derived aromatics having an API gravity of 27.5 and distillation range of from 360° F. to 412° F. and sold commercially by the Union Oil Company of California.

At normal concentration, i.e., 0.47 percent by volume, the above-described cold weather, diesel additive package does not visibly affect the cloud point of the No. 2 diesel fuel into which it is incorporated. It does, however, lower the fuel pour point from −10° F. to −60° F.

The additive-containing, No. 2 diesel fuel filters rapidly through the Oldsmobile filter (see Example I) at −10.5° F., −13.9° F. and quite satisfactorily at −17.1° F. A gradual decrease in fuel flow at −20.9° F. indicates a gradual filter plugging, but the plugging rate is not nearly as catastrophic as that observed at −13.7° F. with the additive-free fuel. Finally, the cetane number of the diesel fuel is increased from 43 to 47 when the above-described cold flow additive is incorporated in the fuel composition.

EXAMPLE III

A cold flow improver for No. 2 diesel fuel is prepared by adding to 58.8 volume percent of solvent G, 11.5 volume percent of vinyl acetate homopolymer having a molecular weight of 8,000, 23.3 volume percent of mixed primary octyl nitrates (Ethyl DII-3), 4.0 volume percent of isopropanol, and 2.4 volume percent of methanol. The above-described components are mixed together using a standard mixing apparatus, i.e., a Waring blender equipped with mixing means. The mixture thus formed has excellent shelf life and maintains a homogeneous mix of components during long storage periods.

EXAMPLE IV

An improvement in cold flow properties is imparted to a No. 2 diesel fuel, substantially as described in Example I, by adding 12 fluid ounces of the cold flow additive of Example III to 20 gallons of said diesel fuel. The pour point, anti-icing properties, cetane number and wax modification properties of the No. 2 diesel fuel are substantially improved by the addition thereto of the cold flow additive.

EXAMPLE V

An improvement in cold flow properties is imparted to No. 2 diesel fuel by following the procedure of Example II with the following exception:

A vinyl acetate-ethylene copolymer having a molecular weight of 8,000 is substituted for the vinyl acetate homopolymer. Substantially the same results occur, with an improvement in cold flow, anti-icing and cetane properties of the No. 2 diesel properties.

EXAMPLE VI

An improvement in cold flow properties is imparted to a No. 2 heating oil by following the procedure of Example II with the following exception:

No. 2 heating oil is substituted for the No. 2 diesel fuel, mixed amy nitrates (Ethyl DII) are substituted for the mixed octyl nitrates and a vinyl acetate-methacrylic ester copolymer having a molecular weight of 8,000 is substituted for the vinyl acetate homopolymer. The pour point, anti-icing properties, cetane number and wax modification properties of the No. 2 heating oil are substantially improved by the addition thereto of the cold flow additive.

Obviously, many modifications and variations of the invention, as hereinabove set forth, can be made without departing from the spirit and scope thereof, and therefore only such limitations should be imposed as are indicated in the appended claims.

I claim:

1. A middle distillate fuel oil having improved cold flow, cetane and anti-icing properties which comprises a mixture of a major amount of a middle distillate hydrocarbon stock and a minor amount of a cold flow additive, wherein said cold flow additive comprises:

(A) from 3 to 24 percent by volume of an ethylene-vinyl acetate copolymer, a vinyl acetate homopolymer, a vinyl acetate-acrylic ester copolymer, or a vinyl acetate-methacrylic ester copolymer, or a mixture thereof, wherein the alkyl group of the ester contains from 6 to 16 carbon atoms, said copolymers and homopolymers having molecular weights within the range of from 800 to 120,000, (B) from 4 to 41 percent by volume of a paraffinic nitrate, or a mixture of paraffinic nitrates, wherein the paraffinic group contains from 4 to 16 carbon atoms, (C) from 2 to 15 percent by volume of an aliphatic alcohol having from 1 to 6 carbon atoms, or a mixture thereof, and (D) from 12 to 91 percent by volume of an aromatic solvent having a gravity within the range of from 25° to 32° API, and boils within the range of from 275° to 550° F.

2. The middle distillate fuel oil defined in claim 1 which contains from 0.1 to 5.0 percent by volume of said cold flow additive.

3. The middle distillate fuel oil defined in claim 1 wherein said paraffinic nitrate is butyl nitrate, amyl nitrate, hexyl nitrate, heptyl nitrate, octyl nitrate, nonyl nitrate, decyl nitrate, undecyl nitrate, dodecyl nitrate, tridecyl nitrate, tetradecyl nitrate, pentadecyl nitrate or hexadecyl nitrate or a mixture thereof.

4. The middle distillate fuel oil defined in claim 1 wherein said aliphatic alcohol is methanol, ethanol, propanol, isopropanol, butanol, petanol, cyclopentanol, hexanol, or cyclohexanol, or a mixture thereof.

5. The middle distillate fuel oil defined in claim 1 wherein said aliphatic alcohol comprises a mixture of methanol and isopropanol in a volume ratio of from 1:2 to 1:10 parts of methanol per part of isopropanol.

6. A middle distillate fuel oil having improved cold flow, cetane and anti-icing properties which comprises a major amount of a middle distillate hydrocarbon stock and from 0.2 to 2.0 percent by volume of a cold flow additive, wherein said cold flow additive comprises:

(A) from 3 to 20 percent by volume of an ethylene-vinyl acetate copolymer, a vinyl acetate homopolymer, a vinyl acetate-acrylic ester copolymer, or a vinyl acetate-methacrylic ester copolymer, or a mixture thereof, wherein the alkyl group of the ester contains from 6 to 16 carbon atoms, said copolymer and homopolymers having molecular weights within the range of from 800 to 120,000, (B) from 4 to 35 percent by volume of a paraffinic nitrate or a mixture of paraffinic nitrates, wherein the paraffinic group contains from 4 to 16 carbon atoms, (C) from 2 to 12 percent by volume of an aliphatic alcohol having from 1 to 6 carbon atoms, or a mixture thereof, and (D) from 12 to 80 percent by volume of an aromatic solvent having a gravity within the range of from 26° to 28° API, and which boils within the range of from 360° to 420° F.

7. The middle distillate fuel oil defined in claim 6 wherein said paraffinic nitrate is butyl nitrate, amyl nitrate, hexyl nitrate, heptyl nitrate, octyl nitrate, nonyl nitrate, decyl nitrate, undecyl nitrate, dodecyl nitrate, tridecyl nitrate, tetradecy nitrate, pentadecyl nitrate, or hexadecyl nitrate, or a mixture thereof.

8. The middle distillate fuel oil defined in claim 6 wherein said aliphatic alcohol is methanol, ethanol, propanol, isopropanol, butanol, pentanol, cyclopentanol, hexanol, or cyclohexanol, or a mixture thereof.

9. The middle distillate fuel oil defined in claim 6 wherein said aliphatic alcohol comprises a mixture of methanol and isopropanol in a volume ratio of from 1:8 to 1:10 parts of methanol per part of isopropanol.

10. A middle distillate fuel oil having improved cold flow, cetane and anti-icing properties which compries a mixture of a major amount of a middle distillate hydrocarbon stock and 0.2 to 2.0 percent by volume of a cold flow additive, wherein said cold flow additive comprises:

(A) from 3 to 20 percent by volume of an ethylene-vinyl acetate copolymer having a molecular weight within the range of from 800 to 100,000, (B) from 4 to 35 percent by volume of octyl nitrate, and mixtures thereof, (C) from 2 to 12 percent by volume of a mixture of methanol and isopropanol in a volume ratio of from 1:2 to 1:10 parts of methanol per part of isopropanol, and (D) from 12 to 80 percent by volume of an aromatic solvent having a gravity within the range of from 26.0° to 28.0° API and which boils within the range of from 360° to 420° F.

11. A cold flow additive for middle distillate fuel oil which comprises:

(A) from 3 to 24 percent by volume of an ethylene-vinyl acetate copolymer, a vinyl acetate homopolymer, a vinyl acetate-acrylic ester copolymer, or a vinyl acetate-methacrylic esster copolymer, or a mixture thereof, wherein the alkyl group of the ester contains from 6 to 16 carbon atoms, said copolymers and homopolymers having molecular weights within the range of from 800 to 120,000, (B) from 4 to 41 percent by volume of a paraffinic nitrate or mixture of paraffinic nitrates, wherein the paraffinic group contains from 4 to 16 carbon atoms, (C) from 2 to 15 percent by volume of an aliphatic alcohol, having from 1 to 6 carbon atoms or a mixture thereof, and (D) from 12 to 91 percent by volume of an aromatic solvent having a gravity within the range of from 25° to 32° API, and which boils within the range of from 275° to 550° F.

12. The cold flow additive defined in claim 11 wherein said paraffinic nitrate is butyl nitrate, amyl nitrate, hexyl nitrate, heptyl nitrate, octyl nitrate, nonyl nitrate, decyl nitrate, undecyl nitrate, dodecyl nitrate, tridecyl nitrate, tetradecyl nitrate, pentadecyl nitrate or hexadecyl nitrate, or a mixture thereof.

13. The cold flow additive defined in claim 11 wherein said aliphatic alcohol is methanol, ethanol, propanol, isopropanol, butanol, pentanol, cyclopentanol, hexanol, or cyclohexanol, or a mixture thereof.

14. The cold flow additive defined in claim 11 wherein said aliphatic alcohol comprises a mixture of methanol and isopropanol in a volume ratio of from 1:2 to 1:8 parts of methanol per part of isopropanol.

15. A cold flow additive for middle distillate fuel oil which comprises:

(A) from 3 to 24 percent by volume of an ethylene-vinyl acetate copolymer, a vinyl acetate homopolymer, a vinyl acetate-acrylic ester copolymer, or a vinyl acetate-methacrylic ester copolymer, or a mixture thereof, wherein the alkyl group of the ester contains from 6 to 16 carbon atoms, said copolymers and homopolymers having molecular weights within the range of from 800 to 120,000, (B) from 4 to 41 percent by volume of a paraffinic nitrate or a mixture of paraffinic nitrates wherein the paraffinic group contains from 4 to 16 carbon atoms, (C) from 2 to 15 percent by volume of an aliphatic alcohol having from 1 to 6 carbon atoms, and (D) from 12 to 91 percent by volume of an aromatic solvent having a gravity within the range of from 25° to 32° API, and which boils within the range of from 275° to 550° F.

16. The cold flow additive defined in claim 15 wherein said paraffinic nitrate is butyl nitrate, amyl nitrate, hexyl nitrate, heptyl nitrate, octyl nitrate, nonyl nitrate, decyl nitrate, undecyl nitrate, dodecyl nitrate, tridecyl nitrate, tetradecyl nitrate, pentadecyl nitrate, or hexadecy nitrate or a mixture thereof.

17. The cold flow additive defined in claim 15 wherein said aliphatic alcohol is methanol, ethanol, propanol, isopropanol, butanol, pentanol, cyclopentanol, hexanol, or cyclohexanol, or a mixture thereof.

18. The cold flow additive defined in claim 15 wherein said aliphatic alcohol comprises a mixture of methanol and isopropanol in a volume ratio from 1:2 to 1:10 parts of methanol per part of isopropanol.

19. A cold flow additive for middle distillate fuel oil which comprises:

(A) from 3 to 24 percent by volume of an ethylene-vinyl acetate copolymer having a molecular weight within the range of from 800 to 120,000, (B) from 4 to 41 percent by volume of octyl nitrate, (C) from 2 to 15 percent by volume of a mixture of methanol and isopropanol in a volume ratio of from 1:2 to 1:10 parts of methanol per part of isopropanol, and (D) from 12 to 91 percent by volume of an aromatic solvent having a gravity within the range of from 26.0° to 28.0° API and which boils within the range of from 360° to 420° F.

20. A cold flow additive for middle distillate fuel oil which comprises:

(A) from 3 to 20 percent by volume of an ethylene-vinyl acetate copolymer, a vinyl acetate homopolymer, a vinyl acetate-acrylic ester copolymer, or a vinyl acetate-methacrylic ester compolymer, or a mixture thereof, wherein the alkyl group of the ester contains from 6 to 16 carbon atoms, said copolymers, and homopolymers having molecular weights within the range of from 800 to 120,000, (B) from 4 to 35 percent by volume of a paraffinic nitrate or a mixture of paraffinic nitrates, wherein the paraffinic group contains from 4 to 16 carbon atoms, (C) from 2 to 12 percent by volume of an aliphatic alcohol having from 1 to 6 carbon atoms, or a mixture thereof, and (D) from 12 to 80 percent by volume of an aromatic solvent having a gravity within the range of from 26° to 28° API, and which boils within the range of from 360° to 420° F.

21. The cold flow additive defined in claim 20 wherein said paraffinic nitrate is butyl nitrate, amyl nitrate, hexyl nitrate, heptyl nitrate, octyl nitrate, nonyl nitrate, decyl nitrate, undecyl nitrate, dodecyl nitrate, tridecyl nitrate, tetradecyl nitrate, pentadecyl nitrate, or hexadecyl nitrate, or a mixture thereof.

22. The cold flow additive defined in claim 20 wherein said aliphatic alcohol is methanol, ethanol, propanol, isopropanol, butanol, pentanol, cyclopentanol, hexanol, or cyclohexanol, or a mixture thereof.

23. The cold flow additive defined in claim 20 wherein said aliphatic alcohol comprises a mixture of methanol and isopropanol in a volume ratio of from 1:2 to 1:8 parts of methanol per part of isopropanol.

24. A cold flow additive for middle distillate fuel oil which comprises:

(A) from 3 to 20 percent by volume of an ethylene-vinyl acetate copolymer having a molecular weight within the range of from 800 to 100,000, (B) from 4 to 35 percent by volume of octyl nitrate, and mixtures thereof, (C) from 2 to 12 percent by volume of a mixture of methanol and isopropanol in a volume ratio of from 1:2 to 1:10 parts of methanol per part of isopropanol, and (D) from 12 to 80 percent by volume of an atomatic solvent having a gravity within the range of from 26.0° to 28.0° API and which boils within the range of from 260° to 420° F.

* * * * *